US005940900A

United States Patent [19]

Wells

[11] Patent Number: 5,940,900

[45] Date of Patent: Aug. 24, 1999

[54] SHAMPOO CHAIR WITH FILTER HEADREST

[76] Inventor: Reneé L. Wells, 1252 NW. 172 Ter., Miami, Fla. 33169

[21] Appl. No.: 09/168,578

[22] Filed: Oct. 8, 1998

[51] Int. Cl.[6] ..... A45D 19/00

[52] U.S. Cl. ..... 4/515; 4/516; 4/571.1; 4/578.1; 297/61; 297/353

[58] Field of Search ..... 4/515, 516, 517, 4/571.1, 572.1, 573.1, 575.1, 578.1, 579, 560.1, 605, 611; 297/61, 353, 391, 396, 452.26

[56] References Cited

U.S. PATENT DOCUMENTS

| | | | |
|---|---|---|---|
| 121,921 | 12/1871 | Winn | 4/515 |
| 4,754,503 | 7/1988 | Martin | 4/515 |
| 5,181,284 | 1/1993 | Raphael et al. | 4/572.1 |
| 5,297,300 | 3/1994 | Sheu | 4/572.1 |
| 5,491,850 | 2/1996 | Kiester | 4/572.1 |
| 5,535,458 | 7/1996 | Siverly | 4/573.1 |
| 5,599,063 | 2/1997 | Lister et al. | 297/325 |
| 5,687,433 | 11/1997 | Gainer et al. | 4/572.1 |
| 5,708,992 | 1/1998 | Gobbers et al. | 4/578.1 |
| 5,722,100 | 3/1998 | Jozwiak | 4/572.1 |

*Primary Examiner*—David J. Walczak
*Attorney, Agent, or Firm*—Joseph N. Breaux

[57] ABSTRACT

A shampoo chair with a filter headrest that includes a securing mechanism that is securable to the bottom of a bathtub and that includes a seat for supporting a small child at a comfortable height for a person shampooing the child's hair. The filter headrest is constructed from a rigid, porous, non-absorbent material.

1 Claim, 2 Drawing Sheets

SHAMPOO CHAIR WITH FILTER HEADREST

TECHNICAL FIELD

The present invention relates to shampooing equipment and more particularly to a shampoo chair with a filter headrest for trapping hair that is positionable into a bathtub and that includes a seat assembly and a backrest assembly; the seat assembly including a rigid, closed cell foam, seat portion, four legs extending from the underside of the seat portion, four suction cup securing devices, one secured to the end of each of the four legs, a seat belt assembly attached to the seat portion, an angled backrest receiving slot formed through the seat portion, two backrest locking pin apertures formed through the sidewalls of the seat portion and into connection with the angled backrest receiving slot, and two backrest position locking pins each having a head portion attached to a pin portion positionable into the angled backrest receiving slot through a backrest locking pin aperture; the backrest assembly including a rigid, closed cell foam backrest portion, a torso belt assembly and a rigid, porous, non-absorbent foam filter headrest portion; the backrest portion being sized to slide through the angled backrest receiving slot of the seat portion and having two opposed sidewalls, a back support surface and a top wall, the two sidewalls each having a number of spaced pin portion receiving cavities, each sized to receive therein the pin portion of a backrest position locking pin and positioned so as to be slidably positionable into registration with one of the two backrest locking pin apertures formed through the seat portion, the top wall including a pair of headrest support rod receiving cavities; the torso belt assembly including two belt sections secured to the backrest portion and including a fastening mechanism for securing the free ends of the belt section together; the filter headrest portion having a pair of rigid headrest support rods extending from a lower surface thereof that are simultaneously friction fit insertable into the pair of headrest support rod receiving cavities.

BACKGROUND ART

Shampooing the hair of small children and toddlers in a bathtub can be difficult because the bathtub surface is so low. It would be a benefit, therefore, to have a shampoo chair that could be secured to the bottom of the bathtub and that provided a seat for supporting a small child at a comfortable height for the person shampooing the child's hair. Because shampooing can dislodge a large quantity of hair from the scalp, it would be a further benefit to have a shampoo chair that included a headrest constructed from a rigid, porous, non-absorbent material that could support the head of the child while simultaneously filtering hair from the rinse water and the like to prevent the hair from clogging the bathtub drain.

GENERAL SUMMARY DISCUSSION OF INVENTION

It is thus an object of the invention to provide a shampoo chair that includes a securing mechanism that is securable to the bottom of a bathtub and that includes a seat for supporting a small child at a comfortable height for a person shampooing the child's hair.

It is a further object of the invention to provide a shampoo chair that includes a headrest constructed from a rigid, porous, non-absorbent material.

It is a still further object of the invention to provide a shampoo chair with filter headrest that includes a seat assembly and a backrest assembly; the seat assembly including a rigid, closed cell foam, seat portion, four legs extending from the underside of the seat portion, four suction cup securing devices, one secured to the end of each of the four legs, a seat belt assembly attached to the seat portion, an angled backrest receiving slot formed through the seat portion, two backrest locking pin apertures formed through the sidewalls of the seat portion and into connection with the angled backrest receiving slot, and two backrest position locking pins each having a head portion attached to a pin portion positionable into the angled backrest receiving slot through a backrest locking pin aperture; the backrest assembly including a rigid, closed cell foam backrest portion, a torso belt assembly and a rigid, porous, non-absorbent foam filter headrest portion; the backrest portion being sized to slide through the angled backrest receiving slot of the seat portion and having two opposed sidewalls, a back support surface and a top wall, the two sidewalls each having a number of spaced pin portion receiving cavities, each sized to receive therein the pin portion of a backrest position locking pin and positioned so as to be slidably positionable into registration with one of the two backrest locking pin apertures formed through the seat portion, the top wall including a pair of headrest support rod receiving cavities; the torso belt assembly including two belt sections secured to the backrest portion and including a fastening mechanism for securing the free ends of the belt section together; the filter headrest portion having a pair of rigid headrest support rods extending from a lower surface thereof that are simultaneously friction fit insertable into the pair of headrest support rod receiving cavities.

It is a still further object of the invention to provide a shampoo chair with filter headrest that accomplishes some or all of the above objects in combination.

Accordingly, a shampoo chair with filter headrest is provided. The shampoo chair with filter headrest includes a seat assembly and a backrest assembly; the seat assembly including a rigid, closed cell foam, seat portion, four legs extending from the underside of the seat portion, four suction cup securing devices, one secured to the end of each of the four legs, a seat belt assembly attached to the seat portion, an angled backrest receiving slot formed through the seat portion, two backrest locking pin apertures formed through the sidewalls of the seat portion and into connection with the angled backrest receiving slot, and two backrest position locking pins each having a head portion attached to a pin portion positionable into the angled backrest receiving slot through a backrest locking pin aperture; the backrest assembly including a rigid, closed cell foam backrest portion, a torso belt assembly and a rigid, porous, non-absorbent foam filter headrest portion; the backrest portion being sized to slide through the angled backrest receiving slot of the seat portion and having two opposed sidewalls, a back support surface and a top wall, the two sidewalls each having a number of spaced pin portion receiving cavities, each sized to receive therein the pin portion of a backrest position locking pin and positioned so as to be slidably positionable into registration with one of the two backrest locking pin apertures formed through the seat portion, the top wall including a pair of headrest support rod receiving cavities; the torso belt assembly including two belt sections secured to the backrest portion and including a fastening mechanism for securing the free ends of the belt section together; the filter headrest portion having a pair of rigid headrest support rods extending from a lower surface thereof that are simultaneously friction fit insertable into the pair of headrest support rod receiving cavities.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
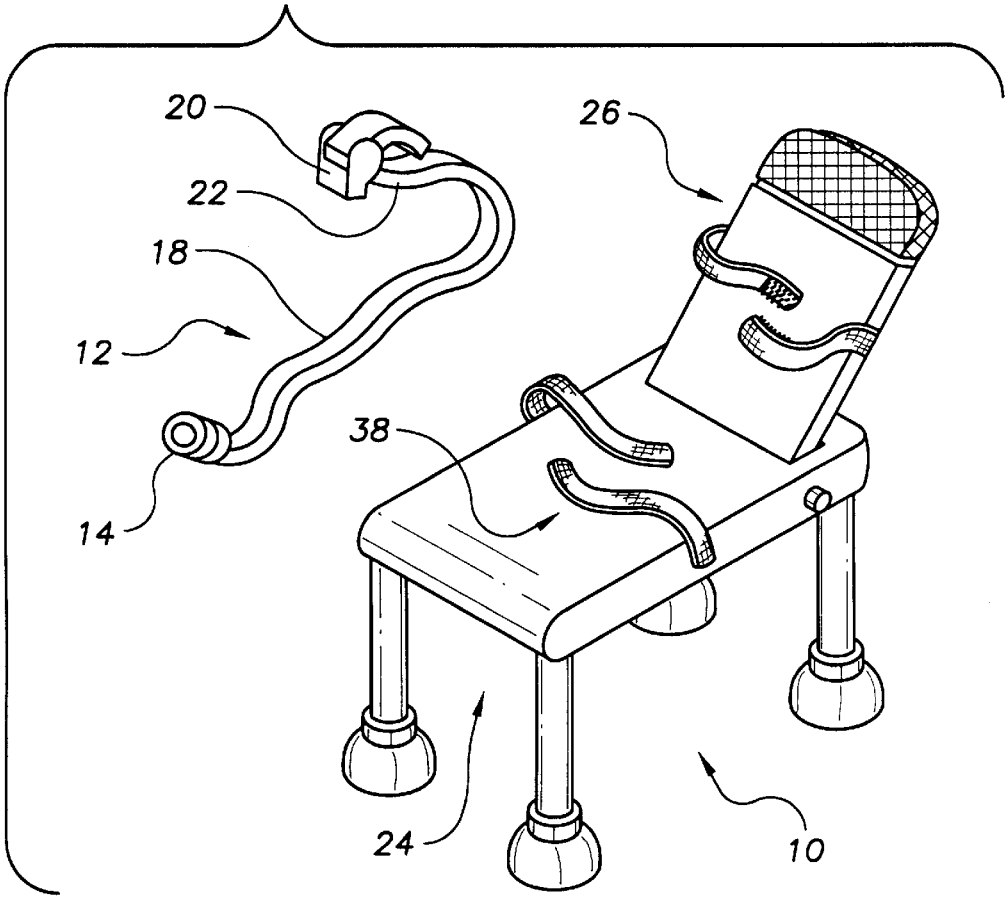
FIG. 1 is a perspective view of an exemplary embodiment of the shampoo chair with filter headrest of the present invention along with a representative rinsing nozzle and hose unit showing the seat assembly and the backrest assembly.

FIG. 1 shows an exemplary embodiment of the shampoo chair with filter headrest of the present invention, generally designated 10, along with a representative rinsing nozzle and hose unit, generally designated 12. Rinsing nozzle and hose unit 12 includes an attachment fitting 14 for attaching a flexible hose section 18 to a bathtub faucet. A rinsing nozzle 20, provided at the far end 22 of hose section 18, allows the shampooer to conveniently spray water as needed.

Figure 2:
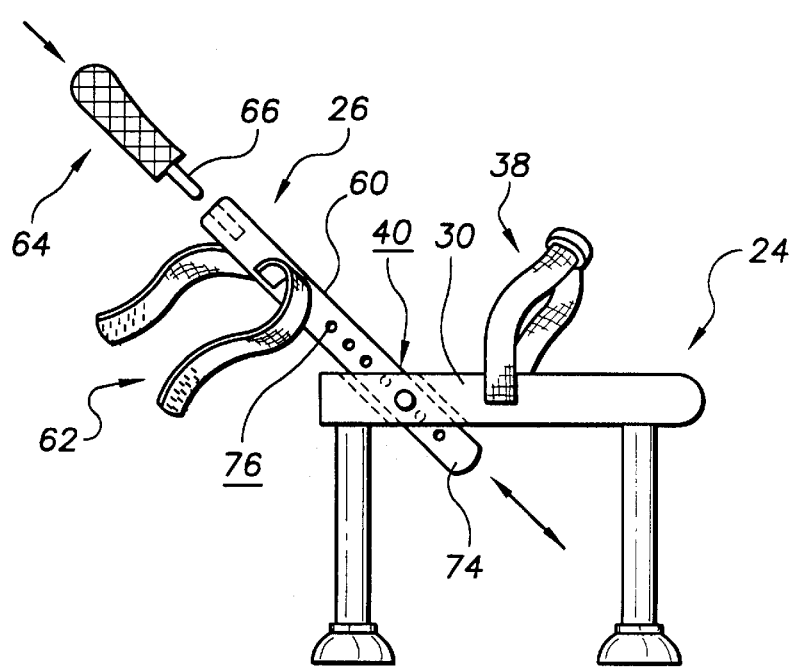
FIG. 2 is a side plan view of the shampoo chair with filter headrest of FIG. 1 showing the seat assembly including the rigid, closed cell foam, seat portion; two of the four legs extending from the underside of the seat portion; two of the four suction cup securing devices; the seat belt assembly attached to the seat portion, the angled backrest receiving slot formed through the seat portion (shown in dashed lines); and one of the two backrest position locking pins; and the backrest assembly including the rigid, closed cell foam backrest portion slidably positioned through the angled backrest receiving slot formed through the seat portion; the torso belt assembly; and the rigid, porous, non-absorbent foam filter headrest portion.
Figure 3:
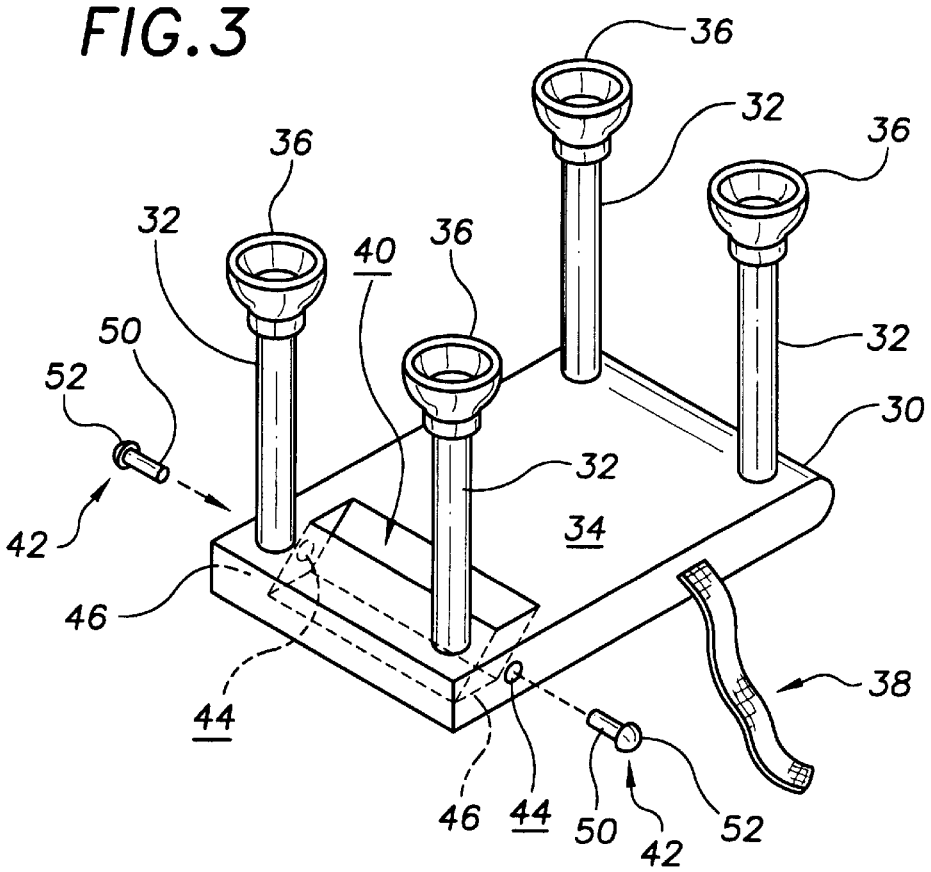
FIG. 3 is a perspective view of the seat assembly of FIGS. 1 and 2 in isolation showing the underside of the rigid, closed cell foam, seat portion; the four legs extending from the underside of the seat portion; the four suction cup securing devices; the angled backrest receiving slot formed through the seat portion; the two backrest locking pin apertures formed through the sidewalls of the seat portion and into connection with the angled backrest receiving slot; and the two backrest position locking pins each having a head portion attached to a pin portion.

Shampoo chair with filter headrest 10 includes a seat assembly, generally designated 24, and a backrest assembly, generally designated 26. With reference to FIG. 2, seat assembly 24 includes a rigid, closed cell foam, seat portion 30; and referring now to FIG. 3, four legs 32 extending from an underside 34 of seat portion 30; four suction cup securing devices 36; a seat belt assembly 38 (see also FIGS. 1 and 2) attached to seat portion 30, an angled backrest receiving slot 40 formed through seat portion 30; two backrest locking pin apertures 44 formed through seat portion sidewalls 46 of seat portion 30 and into connection with angled backrest receiving slot 40; and two backrest position locking pins 42. Each backrest position locking pin 42 includes a pin portion 50 and a head portion 52.

Figure 4:
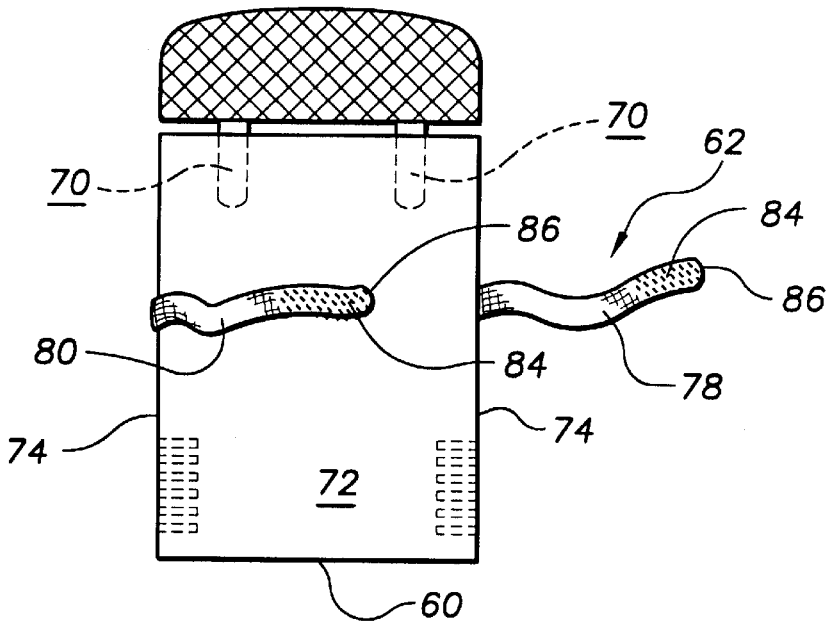
FIG. 4 is a front plan view of the backrest assembly of FIGS. 1 and 2 in isolation showing the back support surface of the rigid, closed cell foam backrest portion; the two belt sections of the torso belt assembly with the companionate hook and pile fasteners at the free ends of the belt sections; the two rigid headrest support rods of the rigid, porous, non-absorbent foam filter headrest portion friction fit into the pair of headrest support rod receiving cavities (shown in dashed lines) formed within the backrest portion.

Referring back to FIG. 2, backrest assembly 26 includes a rigid, closed cell foam backrest portion 60 that is slidably positioned through angled backrest receiving slot 40 of seat portion 30; a torso belt assembly 62; and a rigid, porous, non-absorbent foam filter headrest portion 64. Filter headrest portion 64 includes two rigid headrest support rods 66 (only one shown) that friction fit into, with reference now to FIG. 4, a pair of headrest support rod receiving cavities 70 (shown in dashed lines) formed within backrest portion 60. Backrest portion 60 has a planar back support surface 72 for supporting the back of a user and two opposed sidewalls 74 each having a row of spaced pin portion receiving cavities 76 (see also FIG. 2). Torso belt assembly 62 includes two belt sections 78,80 that are attached to backrest portion 60 that each have a section of companionate hook and pile fastener material 84 at a free end 86 thereof.

It can be seen from the preceding description that a shampoo chair with filter headrest has been provided that includes a securing mechanism that is securable to the bottom of a bathtub and that includes a seat for supporting a small child at a comfortable height for a person shampooing the child's hair; that includes a headrest constructed from a rigid, porous, non-absorbent material; and that includes a seat assembly and a backrest assembly; the seat assembly including a rigid, closed cell foam, seat portion, four legs extending from the underside of the seat portion, four suction cup securing devices, one secured to the end of each of the four legs, a seat belt assembly attached to the seat portion, an angled backrest receiving slot formed through the seat portion, two backrest locking pin apertures formed through the sidewalls of the seat portion and into connection with the angled backrest receiving slot, and two backrest position locking pins each having a head portion attached to a pin portion positionable into the angled backrest receiving slot through a backrest locking pin aperture; the backrest assembly including a rigid, closed cell foam backrest portion, a torso belt assembly and a rigid, porous, non-absorbent foam filter headrest portion; the backrest portion being sized to slide through the angled backrest receiving slot of the seat portion and having two opposed sidewalls, a back support surface and a top wall, the two sidewalls each having a number of spaced pin portion receiving cavities, each sized to receive therein the pin portion of a backrest position locking pin and positioned so as to be slidably positionable into registration with one of the two backrest locking pin apertures formed through the seat portion, the top wall including a pair of headrest support rod receiving cavities; the torso belt assembly including two belt sections secured to the backrest portion and including a fastening mechanism for securing the free ends of the belt section together; the filter headrest portion having a pair of rigid headrest support rods extending from a lower surface thereof that are simultaneously friction fit insertable into the pair of headrest support rod receiving cavities.

It is noted that the embodiment of the shampoo chair with filter headrest described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A shampoo chair with filter headrest comprising:

a seat assembly; and a backrest assembly;

said seat assembly including a rigid, closed cell foam, seat portion, four legs extending from an underside of said seat portion, four suction cup securing devices, one secured to an end of each of said four legs, a seat belt assembly attached to said seat portion, an angled backrest receiving slot formed through said seat portion, two backrest locking pin apertures formed through two seat portion sidewalls of said seat portion and into connection with said angled backrest receiving slot, and two backrest position locking pins each having a head portion attached to a pin portion, said pin portion being positionable into said angled backrest receiving slot through a said backrest locking pin aperture;

said backrest assembly including a rigid, closed cell foam backrest portion, a torso belt assembly and a rigid, porous, non-absorbent foam filter headrest portion;

said backrest portion being sized to slide through said angled backrest receiving slot of said seat portion and having two opposed sidewalls, a back support surface and a top wall, said two opposed sidewalls each having a number of spaced pin portion receiving cavities, each pin portion receiving cavity being sized to receive therein said pin portion of a said backrest position locking pin and positioned so as to be slidably positionable into registration with one of said two backrest locking pin apertures formed through said seat portion, said top wall including a pair of headrest support rod receiving cavities;

said torso belt assembly including two belt sections secured to said backrest portion and a fastening mechanism for securing free ends of said two belt sections together;

said filter headrest portion having a pair of rigid headrest support rods extending from a lower surface thereof that are simultaneously friction fit insertable into said pair of headrest support rod receiving cavities.

* * * * *